US005520384A

United States Patent [19]

Wetzel

[11] Patent Number: 5,520,384

[45] Date of Patent: May 28, 1996

[54] GOLF TRAJECTORY INDICATING DEVICE

[76] Inventor: Dale A. Wetzel, 2708 Miles Ave., Billings, Mont. 59102

[21] Appl. No.: 529,029

[22] Filed: Sep. 15, 1995

[51] Int. Cl.[6] ..... A63B 57/00

[52] U.S. Cl. ..... 473/404; 33/392

[58] Field of Search ..... 33/391, 392, 399, 33/508; 273/32 R, 32 H, 162 B

[56] References Cited

U.S. PATENT DOCUMENTS 3,242,582 3/1966 Garrett ..... 273/32 HX
4,260,151 4/1981 Weaver ..... 273/32 H

*Primary Examiner*—George J. Marlo
*Attorney, Agent, or Firm*—Risto A. Rinne, Jr.

[57] ABSTRACT

An apparatus for determining the direction to impart to a golf ball when putting is disclosed as having a transparent receptacle including at least one longitudinal line on at least one side thereof. A slot is provided in the top of the receptacle that is adapted for placement of a slidable member therein, the slidable member being adapted for motion within the slot. A plumb line is attached at one end thereof to the slidable member and a weight is attached to the remaining end of the plumb line. In use a golfer looks through the receptacle while aligning the longitudinal line over both the golf ball and the target cup simultaneously. The golfer then slides the slidable member within the slot until any portion of the plumb line or the weight is also superimposed simultaneously over the golf ball and the longitudinal line. The plumb line then becomes the preferred direction to impart to the golf ball while automatically compensating for the slope of the golf green so that the ball will naturally curve by force of gravity toward the cup when the ball is impelled in the direction indicated by the plumb line.

20 Claims, 1 Drawing Sheet

GOLF TRAJECTORY INDICATING DEVICE

BACKGROUND OF THE INVENTION

1. Field of the Invention

The present invention, in general, relates to golfing apparatus and, more particularly, to devices used by golfers to indicate the direction to putt a golf ball whilst on the putting green.

Devices to assist golfers putt are well known. However they require the user to tilt the device back and forth while simultaneously aligning various longitudinal and transverse line between the cup, the ball, and the slope of the green in order to determine the direction to putt.

For certain devices, the user must "guess" the average slope of the green that exists between the ball and the cup and then align transverse lines of the device with the estimated inclination of the average slope. Any error in the determination of the slope by the golfer will affect the reliability of the device being used.

Accordingly there exists today a need for a device that easily provides a sight trajectory by which a golfer can attempt to direct the shot (putt) in the direction provided by the device whilst automatically determining, and thus correcting for, the slope of the green.

2. Description of Prior Art

Golf putting devices are, in general, known. For example, the following patents describe various types of these devices:

U.S. Pat. No. 3,870,299 to Howe, Mar. 11, 1975;

U.S. Pat. No. 4,258,475 to Buckley, Mar. 31, 1981;

U.S. Pat. No. 4,260,151 to Weaver, Apr. 7, 1981;

U.S. Pat. No. 4,984,791 to Labell, Jan. 15, 1991; and

U.S. Pat. No. 5,052,114 to Levenson et al, Oct. 1, 1991.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an important object of the present invention to provide a golf trajectory indicating device that is easy to manufacture.

It is also an object of the invention to provide a golf trajectory indicating device that is easy to use.

Another object of the invention is to provide a golf trajectory indicating device that indicates the preferred direction the ball should be propelled.

Still another object of the invention is to provide a golf trajectory indicating device that compensates for the slope of the golf green in determining the preferred direction the ball should be propelled.

Yet another object of the invention is to provide a golf trajectory indicating device that is compact and easy to transport.

Yet another important object of the invention is to provide a golf trajectory indicating device that eliminates the need for the golfer to "read" the slope of the green and adjust the device to correspond with the estimated slope.

Briefly, a golf trajectory indicating device for use in determining the preferred direction to impart to a golf ball that is constructed in accordance with the principles of the present invention has a transparent receptacle with a central longitudinal line on at least one side thereof. A plumb having a weight disposed at the bottom thereof is attached to a slidable member disposed at the top of the receptacle. In use, the golfer stands behind the ball and aligns the longitudinal line with the ball and the cup. The golfer then slides the slidable member along the top of the box until either any part of the plumb line passes over the golf ball or the weight aligns itself over the golf ball while the longitudinal line continues to intersect both the golf ball and the cup. The line created by the plumb is the preferred direction to impart to the ball. The golfer merely uses the line of the plumb to locate a "target" somewhere along the plumb line and then attempts to hit the ball toward the target but moderating the force so that it only propels the ball approximately as far as the distance the cup is from the ball.

DETAILED DESCRIPTION OF THE INVENTION

Figure 1:
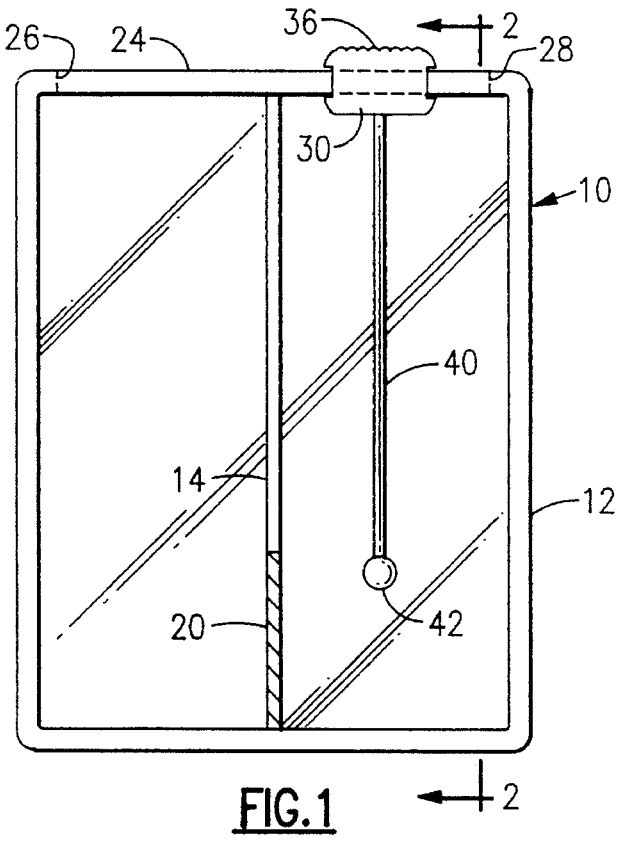
FIG. 1 is a front elevational view of a golf trajectory indicating device.
Figure 2:
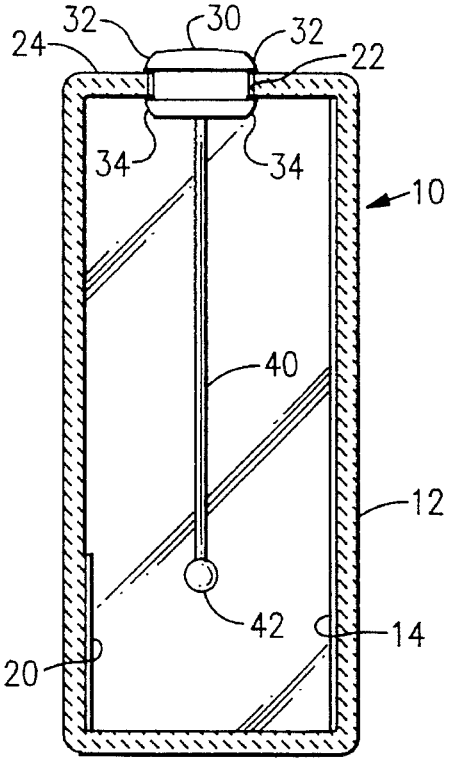
FIG. 2 is a side view of the golf trajectory indicating device as shown in FIG. 1 as seen along the lines 2—2 therein.
Figure 4:
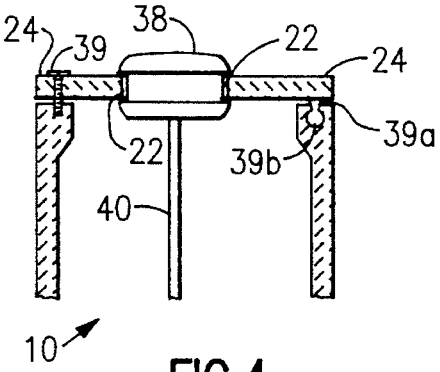
FIG. 4 is a side view of a portion of the golf trajectory indicating device as shown in FIG. 1 as seen along the lines 2—2 therein showing a modified slidable member.
Figure 3:
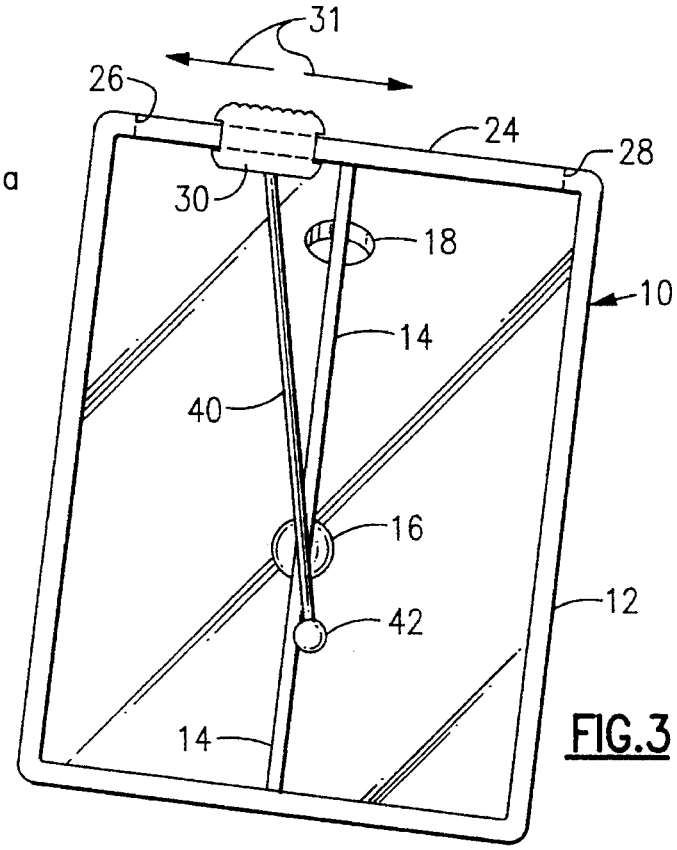
FIG. 3 is a front elevational view of a golf trajectory indicating device in use providing the preferred target trajectory to propel the golf ball.

Referring primarily to FIG. 1, FIG. 2, and FIG. 4, and on occasion to FIG. 3 is shown, a golf trajectory indicating device, identified in general by the reference numeral 10.

A transparent box-like receptacle 12 is shown as having a central longitudinal line 14 on one side thereof. The longitudinal line 14, when the device 10 is in use, is superimposed over both a golf ball 16 and also over a cup 18 as is shown in FIG. 3 with an eye (not shown) of a golfer (not shown) also in alignment with the longitudinal line 14 of the device 10, and the ball 16 and the cup 18. The view as shown in FIG. 3 is the view the eye of the golfer would see while properly using the device to determine the proper direction to impart to the ball 16.

The preferred shape for the receptacle 12 is generally rectangular but it is not limited to that particular shape. A cylindrical, oval, or other shaped receptacle (not shown) would also be functional if it too were to possess the essential elements of construction as are described in greater detail hereinbelow.

The longitudinal line 14 is shown as extending the full length of the one side of the receptacle 12. However, it does not have to extend that far in order for the device 10 to function. It only has to be long enough to cover both the golf ball 16 and the cup 18 simultaneously.

The golfer can hold the device 10 closer to his eyes to permit a shorter longitudinal line (not shown) to cover both the golf ball 16 and the cup 18. For ease of use though, the longitudinal line 14 is made as long as is preferred.

The longitudinal line 14 may be applied over one side of the receptacle 12 and held in place such as by an adhesive or it may be etched into or otherwise formed integrally with the one side of the receptacle 12.

While at a minimum the longitudinal line 14 is shown on only the one side of the receptacle 12, if it is desired, a second longitudinal line 20 is included on the remaining side of the receptacle 12 that is opposite the one side where the longitudinal line 14 is placed.

The second longitudinal line 20 is shown in FIG. 2 and it also is not required to extend along the full length of the receptacle 12. The second longitudinal line 20, in use, is superimposed over the longitudinal line 14 when the longitudinal line 14 is itself superimposed over both the golf ball 16 and also over the cup 18 so as to prevent any parallax error from arising.

A less expensive version of the device 10 may be constructed so as to eliminate the second longitudinal line 20. A more deluxe version of the device 10 may include the second longitudinal line 20 for certain golfers that wish to minimize any potential for error arising in the device 10 as to the determination of where to direct the putt.

A slot 22, which is an elongated opening having a length that is greater than the width thereof, is provided at a top 24 of the receptacle 12 and extends a predetermined amount to a first top side 26 and to a second top side 28 that is disposed opposite to the first top side 26.

A slidable member 30 is disposed in the slot 22 and is adapted for side to side motion as indicated by the pair of arrows 31 in FIG. 3.

As shown in FIG. 2, the slidable member 30 preferably includes a pair of upper retaining lips 32 and a pair of lower retaining lips 34 which serve to maintain the member 30 in a position of cooperation with the slot 22.

The slidable member 30 is urged into its desired position along the length of the slot 22 by the golfer applying a force thereto with any of the fingers (not shown) of the golfer. The member 30 may be urged to slide anywhere within the slot 22 from the first top side 26 and to the second top side 28 and may be positioned anywhere therein along the length of the slot 22.

If desired, a plurality of protrusions 36 are included in the slidable member 30 to facilitate friction between the member 30 and any of the fingers of the golfer thereby making it easier to urge the member 30 within the slot 22.

While it is preferred that the slidable member 30 be retained within the slot 22 as shown in FIG. 2, it is possible to utilize the device with a modified slidable member 38 that is simply placed in the slot 22 as is shown in FIG. 4.

When the modified member 38 is used, care must be taken to maintain the receptacle 12 in an upright attitude or risk the loss of the modified member 38. However for a less expensive version of the device 10, the modified member 38 is suitable.

It is noted that each of the sides which comprise the receptacle 12 are shown as being attached together, thus forming the overall receptacle 12. They are shown in FIGS. 1–3 as being attached by the use of either an adhesive, by welding (such as by solvent, temperature, pressure, or by fusion), or by injection molding techniques; as are well known methods of construction, especially for plastic component parts.

If preferred any side of the receptacle 12 can be attached to any other side as shown in FIG. 4 by the use of a screw 39 or by the corresponding use of a snap together male element **39*a* and a snap together female element 39*b*** each of which are respectively attached to opposite faces of adjoining pieces as is well known in the assembly arts and especially in the plastic components assembly arts.

The receptacle 12 must be transparent enough for the golfer to see both the longitudinal line 14, the golf ball 16 and the cup 18. It is not necessary that every side of the receptacle 12, nor that the entire area of any side be entirely transparent or translucent. Rather a sufficient amount of sufficiently translucent material must be used on the one side where the longitudinal line 14 is disposed and a sufficient amount of translucent material must also be disposed on the side opposite the one side so that the longitudinal line 14, the golf ball 16 and the cup 18 may all be seen simultaneously.

Clear plastic is a preferred material for construction of the translucent portions of the sides of the receptacle 12. Glass or any other translucent material may of course be used. In the FIG. 1 through FIG, 4 drawings, the entire device is shown as being translucent for purposes of disclosing the preferred embodiment and also for the purpose of providing clarity of view in all of the FIG. drawings.

Attached to the side of the slidable member 30 that is disposed inside of the receptacle 12 is a first end of a plumb line 40. The plumb line 40 as shown is constructed of either a flexible material such as a length of string or a rigid material as desired. When the plumb line 40 is constructed of the rigid material it must still permit flex to occur at the first end thereof.

At a second end of the plumb line 40 that is disposed opposite to the first end a weight 42 is attached thereto. The weight 42 provides a mass that is sufficient for the combination of the slidable member 30, the plumb line 40, and the weight 42 to function as a plumb. Accordingly a plumb indicates true vertical by pointing toward the apparent center of gravity of the earth (not shown).

The weight 42 is preferably in the shape of a ball (sphere), for reasons as are described in greater detail hereinbelow although of course, any shape may be used for the weight 42. It may be constructed of any preferred material such as stone, lead, other types of metal, or the like providing it has sufficient mass to act as a plumb.

Operation

Referring now primarily to FIG. 3, the device 10 is held in front of the golfer and is tilted to align the longitudinal line 14 with both the golf ball 16 (As shown in the FIG. 3 drawing the golf ball 16 is disposed directly behind both the longitudinal line 14 and the plumb line 40.) and with the cup 18. The longitudinal line 14 then appears to be superimposed over both the ball 16 and the cup 18.

The slidable member 30 is then urged within the slot 22 in either direction as indicated by either of the pair of arrows 31 until either the weight 42 or the plumb line 40 is also superimposed over the golf ball 16 while the longitudinal line 14 remains superimposed over the ball 16 and the cup 18.

The FIG. 3 drawing does not show the weight 42 as being superimposed over the ball 16, but rather it shows a portion of the plumb line 40 superimposed over the ball 16. Because the weight 42 is disposed at the end of the plumb line 40 it too is also disposed along the same line as that defined by the plumb line 40. Whether the plumb line 40 or the weight 42 intersects (is superimposed) over the ball 16 depends upon the manner in which the device 10 is held by the golfer as is explained in greater detail hereinbelow.

The vantage point of the golfer when using the device 10 and the position he selects to hold the device 10 when he aligns the longitudinal line 14 with the ball 16 and the cup will also determine the portion along the length of the plumb line 40 that intersects the longitudinal line 14. It is possible to raise the device sufficiently with respect to the vantage point of the golfer so that the portion of the plumb line 40 that intersects the longitudinal line 14 when the longitudinal line 14 is superimposed over the ball 16 and the cup 18 is the weight 42.

Of course if the device 10 were raised with respect to the vantage point of the golfer even further, then no portion of the plumb line 40 or the weight 42 could intersect the longitudinal line 14. In that event, the golfer would have to lower the device 10 slightly while using it. A slight amount of use by the golfer of the device 10 will give the golfer a feel in using the device 10 and, accordingly, the golfer should have no difficulty in positioning the device 10 so that either some portion of the plumb line 40 or the weight 42 intersect both the ball 16 and the longitudinal line 14.

Accordingly if the weight 42 is spherical in shape it tends to provide a pleasing appearance when it is superimposed over the ball 16, which is of a similar shape.

Care must be taken to hold the device 10 itself plumb when sliding the member 30 so that the weight 42 does not inadvertently contact any of the inside surfaces of the receptacle 12 thereby lessening the accuracy of the device 10.

Once either the weight 42 or any portion of the plumb line 40 is properly aligned (superimposed) over the longitudinal line 14 and the ball 16, the line indicated by the plumb line 40 is the preferred direction to attempt to direct (hit) the golf ball. The golfer need only pick a target spot anywhere along the line provided by the plumb line 40, remember the target spot, and attempt to hit the golf ball 16 toward the target spot while moderating the force imparted to the ball 16 so that the ball 16 is only impelled approximately as far as the cup 18, into which it hopefully falls.

The slope (inclination) intermediate the ball 16 and the cup 18 has been automatically compensated for by the device 10. When the golf ball 16 is initially impelled along the direction as provided by the plumb line 40, the ball will begin to curve by the force of gravity into an arc that will take it directly toward the cup 18.

If there were no slope present between the ball 16 and the cup 18 then the entire length of the plumb line 40 and the weight 42 would also be superimposed directly over the longitudinal line 14 thereby informing the golfer that the preferred target is to try and impel the golf ball directly toward the cup 18.

Of course certain factors such as the length of the grass (not shown) and the direction of the grain as well as the type of grass should be factored into the calculation to determine the direction to impart to the ball 16, and especially so by a professional golfer or when the ball 16 is especially far away from the cup 18.

However a reliable method of determining the initial direction, absent any mitigating factors, toward which to impel the golf ball 16 is thus attained. Often the initial direction is the preferred direction when the factors as mentioned hereinabove either do not exist or are considered insignificant.

When the second longitudinal line 20 is included as part of the device 10, the golfer must also ensure that during use the second longitudinal line 20 remains superimposed over the longitudinal line 14, thereby eliminating the potential for parallax error.

The invention has been shown, described and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A golf trajectory indicating device for indicating the preferred direction to impart to a golf ball, comprising:

(a) a receptacle having at least two opposing sides and a top, each of said at least two opposing sides having a portion therein that is sufficiently translucent to permit visible light to pass through;

(b) a longitudinal line having a predetermined length and being disposed on said portion of one of said at least two opposing sides;

(c) a slot having a length greater than the width thereof and a first slot end and a second slot end disposed in said top;

(d) a member disposed in said slot and adapted to be urged from said first slot end to said second slot end; and (e) means for providing a plumb attached to said member.

2. The golf trajectory indicating device of claim 1 including a second longitudinal line having a predetermined length and being disposed on said portion of the remainder of said one of said at least two opposing sides.

3. The golf trajectory indicating device of claim 1 including means for retaining said member in a position of cooperation with said slot.

4. The golf trajectory indicating device of claim 3 wherein said means for retaining includes at least one upper lip attached to said member and disposed on a first side of said top and at least one lower lip attached to said member and disposed on a second side opposite said first side of said top.

5. The golf trajectory indicating device of claim 1 wherein said member includes means for improving friction between said member and a finger of a golfer.

6. The golf trajectory indicating device of claim 5 wherein said means for improving friction includes a plurality of protrusions attached to said member.

7. The golf trajectory indicating device of claim 1 including means for attaching said one of said at least two opposing sides to a side other than said one of said at least two opposing sides to form said receptacle.

8. The golf trajectory indicating device of claim 7 wherein said means for attaching includes at least one screw.

9. The golf trajectory indicating device of claim 7 wherein said means for attaching includes at least one snap together male element attached to said one of said at least two opposing sides.

10. The golf trajectory indicating device of claim 9 wherein said means for attaching includes at least one snap together female element attached to said side other than said one of said at least two opposing sides.

11. The golf trajectory indicating device of claim 7 wherein said means for attaching includes an adhesive.

12. The golf trajectory indicating device of claim 7 wherein said means for attaching includes welding.

13. The golf trajectory indicating device of claim 7 wherein said means for attaching includes the use of a solvent.

14. The golf trajectory indicating device of claim 7 wherein said means for attaching includes injection molding.

15. The golf trajectory indicating device of claim 1 wherein said receptacle includes a generally box-like shape thereto.

16. The golf trajectory indicating device of claim 1 wherein said portion is formed of a translucent glass.

17. The golf trajectory indicating device of claim 1 wherein said portion is formed of a translucent plastic.

18. The golf trajectory indicating device of claim 1 wherein said means for providing a plumb includes a plumb line having a first and a second end attached at said first end thereof to said member and attached at said second end thereof to a weight, said weight providing a sufficient mass.

19. The golf trajectory indicating device of claim 18 wherein said plumb line is formed of a flexible material.

20. The golf trajectory indicating device of claim 18 wherein said plumb line is formed of a rigid material.

* * * * *